US007214457B2

(12) United States Patent
Itami et al.

(10) Patent No.: US 7,214,457 B2
(45) **Date of Patent: *May 8, 2007**

(54) ORGANIC PHOTOCONDUCTOR, PROCESS CARTRIDGE, IMAGE FORMING APPARATUS AND IMAGE FORMING METHOD

(75) Inventors: Akihiko Itami, Hachioji (JP); Kazuhisa Shida, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 250 days.

This patent is subject to a terminal disclaimer.

(21) Appl. No.: 10/800,208

(22) Filed: Mar. 12, 2004

(65) Prior Publication Data

US 2004/0265715 A1 Dec. 30, 2004

(30) Foreign Application Priority Data

Jun. 25, 2003 (JP) ..... 2003-180722

(51) Int. Cl.
*G03G 5/047* (2006.01)

(52) U.S. Cl. ..... 430/58.05; 430/60; 399/159

(58) Field of Classification Search ..... 430/58.05, 430/60, 58.65, 58.75; 399/159

See application file for complete search history.

(56) References Cited

U.S. PATENT DOCUMENTS

| | | | | |
|---|---|---|---|---|
| 5,098,810 | A * | 3/1992 | Mizuguchi et al. | 430/78 |
| 5,204,199 | A * | 4/1993 | Sugiuchi et al. | 430/58.85 |
| 5,462,826 | A * | 10/1995 | Shimada et al. | 430/58.8 |
| 5,818,489 | A | 10/1998 | Yoshinaga et al. | |
| 5,824,444 | A * | 10/1998 | Kinoshita et al. | 430/57.3 |
| 6,322,940 | B1 | 11/2001 | Nishigaki et al. | |
| 2003/0049555 | A1 * | 3/2003 | Sakon et al. | 430/124 |

FOREIGN PATENT DOCUMENTS

| | | |
|---|---|---|
| JP | 08-272197 | 10/1996 |

* cited by examiner

*Primary Examiner*—John L. Goodrow
(74) *Attorney, Agent, or Firm*—Lucas & Mercanti, LLP

(57) ABSTRACT

An organic photoconductor including a charge generating layer and a charge transport layer on a conductive base, wherein crossing angleθ of two tangent lines is 70° or more, two tangent lines which border on a curve drawn by plotting integrated values of detected current versus time in measurement of transient photocurrent (TOF), at a field intensity of 10V/μm; and film thickness of the charge transport layer is 8 to 15 μm.

20 Claims, 2 Drawing Sheets

ORGANIC PHOTOCONDUCTOR, PROCESS CARTRIDGE, IMAGE FORMING APPARATUS AND IMAGE FORMING METHOD

BACKGROUND

1. Field of the Invention

The present invention relate to an organic photoconductor used in a field of copying machines and printers (hereinafter simply referred to as a photoconductor) and a process cartridge, an image forming apparatus and an image forming method using the organic photoconductor.

2. Description of Related Art

In earlier technology, in order to improve quality of photoelectorographic image, a technology forming a microscopic dot image in which a fine latent image is formed on an organic photoconductor using exposure light source of small spot diameter has been developed. For example, JP Tokukaihei-8-272197A and U.S. Pat. No. 5,818,489 disclose a method of forming a latent image of high definition on an organic photoconductor using a light source having spot diameter of 4000 μm or less. In order to form an accurate latent image in such spot exposure method of small spot diameter, it is important to reduce the diffusion of charge carrier generated by an exposure in a latent image formation by the image exposure to an organic photoconductor.

That is, in order to reproduce image information faithfully as an electrostatic latent image, it is necessary to keep enough contrast of electric potential between exposed and unexposed part. Thus, it is important to reduce the diffusion of carrier which takes place while the carrier is generated and reach surface charge. For example, Journal of the Imaging Society of Japan 38 (4), in page 296, discloses that the effect of diffusion in electric latent image formation can not ignore about a high density image of such like 1200 dpi, when the ratio of diffusion constant (D) to drift mobility (μ) in charge transport layer D/μ become large, and thus, thicker charge transport layer results larger degradation of a latent image.

Furthermore, as described in Fuji Jihou 75 (3), page 194, the larger drift mobility (μ) in charge transport layer results larger diffusion of a latent image according to an analysis result of single dot latent image. As disclosed in JP Tokukaihei-5-119503A, in a process with high resolution, an organic photoconductor has already proposed, in which thinner charge transport layer is applied and diffusion of electrostatic latent image is prevented.

However, the above-proposed organic photoconductors can not be an enough closure of the problem with respect to durability of photoconductor. That is, tear and wear of the film involved in a repeat use easily cause increase of image defects such as fog, small black spot and the like, because potential stability, sensitivity and the like of organic photoconductor largely depend on the film thickness. In particular, an organic photoconductor having thin photoconductive layer has a tendency that field intensity per film thickness included in conditions of charging potential in electrostatic latent image formation is large, and problems such as degradation of a dot image and elevation of residual potential easily occur.

Photoelectrical apparatuses such as a digital coping machine, a printer and the like in recent years are downsized speeded up as well as high image quality is required. As a result, both higher sensitivity corresponding to speeding up and longer lifetime according to improvement of abrasion resistance are required.

In order to fulfill the above requirement of high image quality, downsizing and speeding up, it is required to enhance time response property in sensitivity of organic photoconductor. In order to fulfill the requirement, a development of electrical charge generation material has been made. As a result, as described in Journal of the Electrophotography Society of Japan 29 (3), page 250 (1990), phthalocyanine pigment such as Y type phthalocyanine (titanil phthalocyanine pigments having a maximum peak at 27.2° in Bragg angle 2θ in character X ray spectrum of Cu—Kα) is developed, and a photoelectrical photoconductor using the pigment thereof is in practical use.

However, charging potential of these photoelectrical photoconductor is not stable in high-speed image forming process in which a line speed of photoconductor is fast and charged time and moving time from exposure process to developing process are short, which cause degradation of a dot image and elevation of residual potential. As a result, fog or degradation of image density easily turns up.

Consequently, in a organic photoconductor required high image quality and high speed property, it has been problematic that change of film thickness of photoconductor involved in repeat use affect size of a electrostatic latent image of dot image and formation of potential contrast, both of which cause degradation of a dot image and elevation of residual potential. As a result, fog or degradation of image density easily turns up. In particular, degradation of a dot image caused by wear and tear of photoconductor easily turn up in a print image of photographic image and the like where a dot image of 1200 dpi or more (dpi is referred to the number of dot in 2.54 cm) is required and reproducibility of gradation is valued. It is necessary to prevent that.

SUMMARY

According to the first aspect, an organic photoconductor comprises a charge generating layer and charge transport layer on a conductive base, wherein:

crossing angleθ of two tangent lines is 70° or more, two tangent lines which border on a curve drawn by plotting integrated values of detected current versus time in measurement of transient photocurrent, or TOF measurement, at a field intensity of 10V/μm; and film thickness of the charge transport layer is 8 to 15 μm.

According to the second aspect, an image forming apparatus comprises the above organic photoconductor, a charging member, an exposure member and a developing member.

According to the third aspect, a process cartridge is removable to an image forming apparatus, and comprises the above organic photoconductor and at least one of a charging member, an exposure member, a developing member, a transferring member and cleaning member.

According to the fourth aspect, an image forming method is one charging the above organic photoconductor, exposing of the charged organic photoconductor in resolution of 1200 dpi or more, and developing an electrostatic latent image formed by the exposure.

By the use of the above organic photoconductor, it become possible to form dot images with high image quality of 1200 dpi or more, provide electrophotographic images which are good in sharpness and gradation property without inferior image, and provide process cartridges, image forming apparatus and methods for image formation using the organic photoconductor.

BRIEF DESCRIPTION OF THE DRAWINGS

The present invention will become more fully understood from the detailed description given hereinbelow and the appended drawings which given by way of illustration only, and thus are not intended as a definition of the limits of the present invention, and wherein.

DETAILED DESCRIPTION OF THE EXEMPLARY EMBODIMENTS

Figure 1:
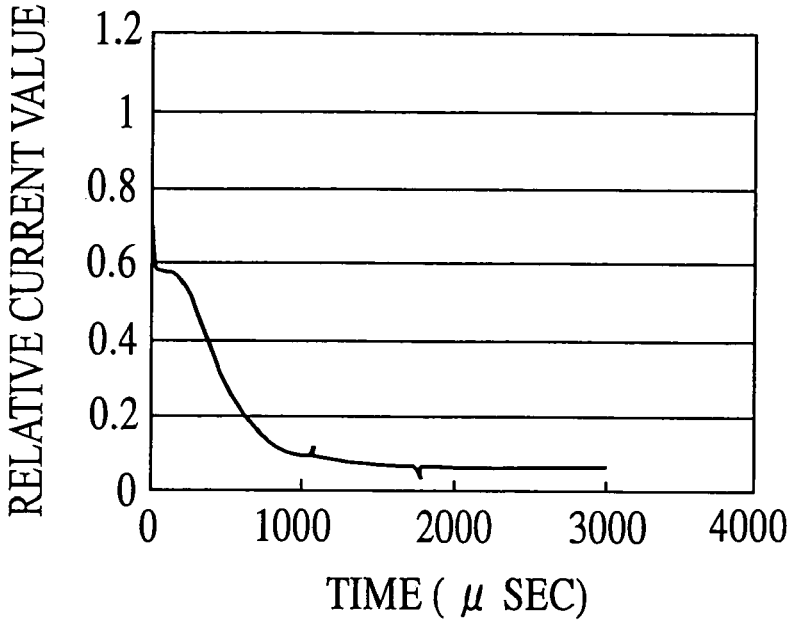
FIG. 1 is one example of data on the measurement of transient photocurrent (TOF) of the organic photoconductor at a field intensity of 10 V/μm.

The present inventors researched and found that it is important to prevent the degradations of size of an electrostatic latent image of dot image and contrast of an image caused by wear and tear of organic photoconductor involved in repeat use in order to forming an electrophotographic images required high resolution of 1200 dpi or more and high speed property. The inventors further found that it is important to prevent diffusion of carrier which is generated in image exposure to organic photoconductor and lower the relativity of size of electrostatic latent image of dot image and contrast of image to film thickness of organic photoconductor in order to accomplish that variation of dot image is small, dot image of high definition can be formed where size and contrast is stable and the image is formed rapidly even when film thickness of photoconductor changes. That is, the variation of electrostatic latent image of dot image according to variation of thickness of organic photoconductor, which easily turn up when organic photoconductor is made thin, can be reduced by keeping distribution of carrier generated by charge and image exposure and restraining a variation of carrier distribution by such ways as carrier generation in charge generating layer (hereinafter also referred to as GCL), carrier injection from charge generating layer to charge transport layer (hereinafter also referred to as CTL), carrier transport in CTL.

The present invention is described in detail below.

The organic photoconductor comprises a charge generating layer (CGL) and a charge transport layer (CTL) preferably in a configuration where CGL and CTL are sequentially laminated on a conductive base substance, wherein a crossing angle α of two tangent lines is 70° or more which border on a curve obtained when integrated values of detected current are plotted versus time in measurement of transient photocurrent (time of flight, TOF) at a field intensity of 10 V/μm, and a film thickness of the charge transport layer is from 8 to 15 μm.

By making an organic photoconductor have the above structure, it becomes possible to form a latent image of a dot image with 1200 dpi or more, and the organic photoconductor is good in fine line reproducibility, where an image quality is not deteriorated even when a large number of images is repeatedly formed.

The organic photoconductor comprises a charge generating layer and a charge transport layer which are sequentially laminated on a conductive base substance and a crossing angle α of two tangent lines is 70° or more which border on a curve obtained when integrated values of detected current are plotted versus time in measurement of transient photocurrent (time of flight, TOF) at a field intensity of 10 V/μm.

That is, the measurement of transient photocurrent (time of flight, TOF) at a field intensity of 10 V/μm is the measurement of transient photocurrent (TOF) under a condition where charging potential of −200 V is added when the organic photoconductor where a film thickness of an insulating layer is 20 μm is supposed, and means the measurement of transient photocurrent (TOF) at a comparatively weak field intensity. In the organic photoconductor, the crossing angle α of two tangent lines is 70° or more which border on a curve obtained when integrated values of detected current are plotted versus time, from this measurement of transient photocurrent (TOF) at a comparatively weak field intensity, and the film thickness of the charge transport layer is from 8 to 15 μm. In such a photoconductor, it is possible to reduce diffusion of carriers generated at courses such as carrier generation in the charge generating layer (hereinafter also referred to as CGL), carrier injection from the charge generating layer to the charge transport layer (hereinafter also referred to as CTL) and carrier transport in CTL, reduce quality variation of high quality electrophotographic images with resolution of 1200 dpi or more even when the organic photoconductor is used for a long time and the film thickness is decreased, and well retain qualities such as fine line reproducibility, gradation property and sharpness.

Here, a method for measuring the transient photocurrent (TOF) and that the crossing angle α of two tangent lines is 70° or more which border on a curve obtained when integrated values of detected current are plotted versus time are illustrated.

Measurement Condition of TOF

The measurement of TOF can be performed by common methods known in the earlier development.

Exposure light source wavelength is a wavelength close to a maximum sensitivity in spectral sensitivity of the photoconductor is used (single wavelength light with a wavelength of the maximum sensitivity×0.9 or more): In the present examples, a Xe flash lamp (supplied from Hamamatsu Photonics KK) was used for the exposure light source, and a monochromatic light of 780 nm which passed through an ND filter and a band pass filter was used.

An exposure intensity was set at a light quantity at which surface charge can be reduced by 1/10 or less, and confirm that proper wave pattern can be detected before the measurement.

Pulse luminescence time: 2 μsec

Sampling speed: 1 μsec

The charging potential V is set such that V/d is 10 V/μm where d represents a summed film thickness of any layers on the support.

Next, it is illustrated that the crossing angle α of two tangent lines is 70° or more, which border on a curve obtained when integrated values of detected current are plotted versus time.

FIG. 1 shows data of the measurement of transient photocurrent (TOF) of the organic photoconductor at a field intensity of 10 V/μm where a horizontal axis (X-axis) is a time axis (μsec), and a vertical axis (Y-axis) is detected current values (relative current values standardized by making the maximum current value 1).

Figure 2:
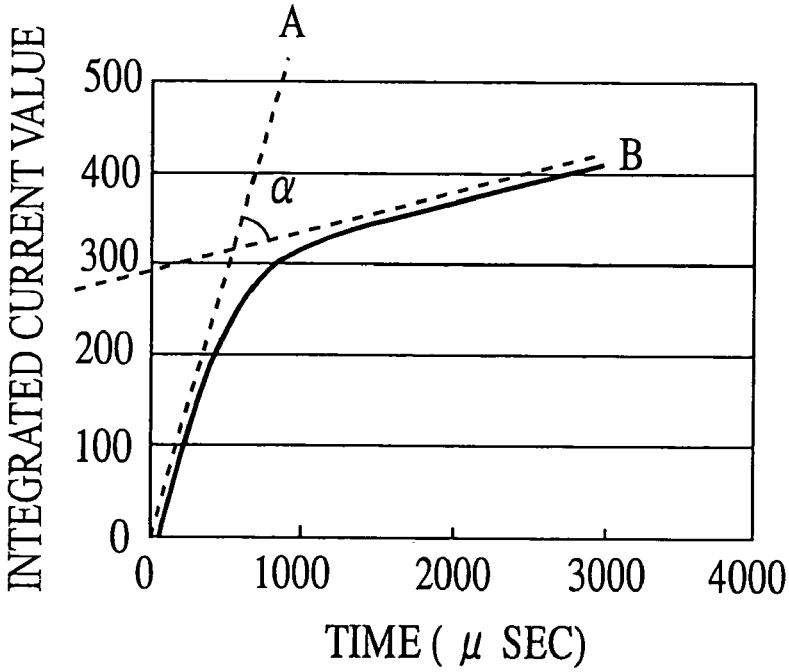
FIG. 2 is a curve obtained by plotting integrated values of the detected current versus time obtained from the data in FIG. 1.

FIG. 2 is a curve obtained by plotting integrated values of the detected current versus time obtained from the data in FIG. 1 where a horizontal axis (X-axis) is a time axis (μsec), and a vertical axis (Y-axis) is the integrated values of the detected current.

The tangent lines which border on a curve obtained when integrated values of detected current are plotted versus time are a tangent line A beginning at an intersecting point of the X and Y axes, i.e., a coordinate origin and a tangent line B beginning at 3000 μsec, and the crossing angle of these two tangent lines is rendered the crossing angle α.

When the organic photoconductor is configured such that the crossing α of above two tangent lines obtained from the measurement at the field intensity of 10 V/μm is 70° or more and the film thickness of the charge transport layer is from 8 to 15 μm, it is possible to obtain the images where film thickness dependency of the resolution is small and the resolution is high even when the film thickness of the organic photoconductor wears and tears due to long term use. When the crossing angle becomes less than 70°, influences of the carriers which delay in response can not be ignored and problems such as residual potential increase at repeat use occur. An upper limit value of the crossing angle α is theoretically 90°.

The organic photoconductor indicates an electrophotographic photoconductor in which an organic compound have at least one function of a charge generating function and a charge transporting function, both of which are essential for the configuration of the electrophotographic photoconductor. The organic photoconductor includes all organic photoconductors known in the art such as photoconductors containing an organic charge generation material or organic charge transport material known in the art and photoconductors having the charge generating function and the charge transporting function by a polymer complex and the like.

The charge transport layer indicates a layer having a function that charge carriers generated in the charge generating layer by light exposure is transported to the surface of the organic photoconductor, and specific detection of the charge transporting function can be confirmed by laminating the charge generating layer and the charge transport layer on a conductive support and detecting light conductivity.

Layer configuration of the organic photoconductor is basically composed of a photoconductor layer including a charge generating layer and a charge transport layer on the conductive support. It can also comprise a surface protective layer the furthest from the conductive support, and an intermediate layer.

In order to impart a property that the crossing angle α of two tangent lines is 70° or more which border on a curve obtained when integrated values of detected current are plotted versus time in the measurement of transient photocurrent (TOF) at a field intensity of 10 V/μm to the organic photoconductor of the invention, it is important to select a combination of a charge generation material (CGM) used for the charge generating layer (CGL) and a charge transport material (CTM) used for the charge transport layer (CTL). That is, it is possible to produce the organic photoconductor where the above crossing angle α of two tangent lines is 70° or more by using pigments with high efficiency of charge carrier generation for CGM and using a charge transport material with good injection efficiency of the charge carriers from the charge generating layer for CTM used for the charge transport layer in order to reduce variance of carriers generated in the charge generating layer in the charge transport layer.

As described above, in producing the organic photoconductor, it is important to select the combination of CGM and CTM described above, but simultaneously, charge generation efficiency, charge injection efficiency, charge transportability and the like subtly change depending on a binder resin in the charge generating layer and a binder resin in the charge transport layer. Thus, it is necessary to select all configurations of the charge transport layer, the charge generating layer, and an intermediate layer which is described below, and the like in order to make the above crossing angle of two tangent lines 70° or more.

The specific configuration of the photoconductor used is described below.

Conductive Support

As the conductive support used for the photoconductor, a sheet-shaped or cylindrical conductive support is used.

The cylindrical conductive support indicates a cylindrical support required for being capable of forming images endlessly by rotating. The conductive support in the range where straightness is 0.1 mm or less and deflection is 0.1 mm or less is preferable. When the straightness and the deflection exceed this range, it becomes difficult to form a fine image.

As materials of the conductive support, it is possible to use metallic drums made of such as aluminum and nickel, or plastic drums where aluminum, tin oxide, indium oxide or the like is deposited, or paper/plastic drums coated with a conductive substance. As the conductive support, a specific resistance at ambient temperature is preferably $10^3$ Ω·cm or less.

As the conductive support used, those where an alumite film given a sealing treatment is formed on the surface can be used. An alumite treatment is typically performed in an acid bath such as chromic acid, sulfuric acid, oxalic acid, phosphoric acid, boric acid and sulfamic acid, and an anodic oxidation treatment in sulfuric acid gives the most preferable result. In the case of the anodic oxidation treatment in sulfuric acid, it is preferable to perform at a sulfuric acid concentration of 100 to 200 g/L, an aluminum ion concentration of 1 to 10 g/L, and at a liquid temperature of around 20° C. and at an applied voltage of about 20 V, but the conditions are not limited thereto. An average film thickness of anodic oxidation films is typically 20 μm or less, and especially 10 μm or less is more preferable.

Photoconductive Layer

<Charge Generating Layer>

The charge generating layer contains the charge generation material (CGM). As the other substances, binder resins and the other additives may be contained if necessary.

For the organic photoconductor, as the charge generation material, it is possible to use phthalocyanine pigments, azo pigments, perylene pigments, azulenium pigments and the like alone or in combination. Among these pigments, titanyl phthalocyanine pigments, gallium phthalocyanine pigments, perylene pigments and the like all of which are highly sensitive and good in potential stability are preferably used. For example, titanyl phthalocyanine pigments having a maximum peak at 27.2° in Bragg angle 2θ of Cu—Kα ray, benzimidazole perylene having a maximum peak at 12.4° in the same 2θ, chlorogallium phthalocyanine pigments having diffraction peaks at least at locations of 7.4°, 16.6°, 25.5° and 28.3° in Bragg angle (2θ±0.2°) in character X-ray diffraction spectrum of Cu—Kα, or hydroxygallium phthalocyanine pigments having diffraction peaks at least at locations of 7.5°, 9.9°, 12.5°, 16.3°, 18.6°, 25.1° and 28.1° are used in good conditions such as almost no change of charging performance and sensitivity involved in repeat uses.

When a binder is used as a dispersion medium of CGM in the charge generating layer, resins known in the art can be used as the binder, but as the most preferable resins, formal resin, butyral resin, silicone resin, silicone modified butyral resin, phenoxy resin, and the like are included. A ratio of the binder resin to the charge generation material is preferably 20 to 600 parts by mass of the charge generation material with respect to 100 parts by mass of the binder resin. By using these resins, it is possible to maximally reduce the residual potential increase involved in the repeat uses. A film thickness of the charge generating layer is preferably from 0.1 μm to 2 μm.

<Charge Transport Layer>

The charge transport layer of the organic photoconductor is basically composed of a charge transport material (CTM) and a binder resin which disperses the CTM and has a film forming function, and the like.

As the charge transport materials, it is possible to use triphenylamine derivatives, butadiene compounds, oxazole derivatives, oxadiazole derivatives, thiazole derivatives, thiadiazole derivatives, triazole derivatives, imidazole derivatives, imidazolone derivatives, imidazoline derivatives, bis-imidazolidine derivatives, styryl compounds, hydrazine compounds, benzidine compounds, pyrazoline derivatives, stilbene compounds, oxazolone derivatives, benzothiazole derivatives, benzimidazole derivatives, quinazoline derivatives, benzofuran derivatives, acridine derivatives, phenazine derivatives, aminostilbene derivatives, poly-N-vinylcarbazole, poly-1-vinylpyrene, poly-9-vinylanthracene, and the like alone or in combination. In order to produce the organic photoconductor where the crossing angle α of two tangent lines is 70° or more by combining with the above charge generation material obtain stable electrophotographic properties (charging ability, sensitivity and the like), it is preferred that the charge transport material is selected from triphenylamine derivatives, styryl compounds, benzidine compounds and butadiene compounds. Layer formation is typically performed by dissolving these charge transport materials in an appropriate binder resin.

As the binder resin in the charge transport layer, it is preferable to use binder resins with small dielectric constant, and polystyrene resins, styrene-butadiene copolymers and the like are included.

Additives such as anti-oxidant may be contained in the charge transport layer if necessary.

As the binder resin used in the charge transport layer (CTL), it is preferable to use binder resins with small dielectric constant regardless of either resin of thermoplastic resins or thermoset resins. It is particularly preferable to use polystyrene resin, styrene-butadiene copolymer, polycarbonate and the like alone or in a blended mixture.

A percentage of the charge transport material in the charge transport layer is preferably from 20 to 35% by mass. By employing the amount range of CTM, it can be prevented form that diffusion of dot images easily becomes large, charge transporting ability is easily reduced, residual electric potential is easily increased and image density is easily reduced.

The charge transport layer may be composed of a plurality of charge transport layers. A film thickness of the charge transport layer of the invention is from 8 to 15 μm, and further more preferably from 9 to 14 μm. When the film thickness of the charge transport layer is in the range of the thickness, electric potential retaining ability of the charging potential can be stable, small black spots and photographic fog can be prevented. In addition, it can be also prevented from that diffusion of the carriers in the charge transport layer easily becomes large, dot images are easily extended and sharpness and gradation property are easily deteriorated.

<Intermediate Layer>

It is preferable to install an intermediate layer between the conductive support and the photoconductive layer, which has a blocking function capable of preventing the injection of the charge from the conductive support.

As the intermediate layer having the blocking function, an under coating layer using polyamide resin and the like, an intermediate layer which doubles with the under coating layer containing inorganic fine particles, a mineral intermediate layer formed from an organic metal compound, and a silane coupling agent and the like are preferably used in terms of balancing the above-described blocking property and an adhesive property with the conductive support or the charge generating layer.

The intermediate layer of the invention is substantially a semiconductive or insulative layer. Here, the semiconductive or insulative indicates that volume resistance is $1\times10^{8}$ Ω·cm or more, and preferably $1\times10^{8}$ to $10^{15}$ Ω·cm. The volume resistance of the intermediate layer is preferably from $1\times10^{9}$ to $10^{14}$ Ω·cm and more preferably from $1\times10^{9}$ to $10^{13}$ Ω·cm.

When the volume resistance is in the range above, it can be prevented form that the intermediate layer become nearly conductive and the electric field intensity easily becomes less than 10 V/μm. Also, the range may cause to prohibit that the blocking property of the charge from the conductive support is easily reduced, potential retaining property of electrophotographic photoconductors is also easily deteriorated, image defects such as small black spots easily occur. Further it may cause to prevent that the residual potential is easily increased in repeated image formations. Thus the fine image quality can be obtained.

The volume resistance can be measured as follows. Measurement condition conforms to JIS: C2318-1975.

Measuring instrument: Hiresta IP supplied from Mitsubishi Petrochemical Co., Ltd.

Measurement condition: Measurement probe HRS

Applied voltage: 500 V

Measurement environment: 30±2° C., 80±5 RH %

The layer with volume resistance of less than $1\times10^{8}$ is regarded as a conductive layer, and when calculating the filed intensity (10 V/μm), it is subtracted from the summed film thickness of the photoconductors.

As the intermediate layer, an intermediate layer containing N type semiconductive particles on the conductive support is preferable.

Here, the N type semiconductive particles indicate fine particles having a nature which utilizes electrons as primary conductive carriers. That is, the nature utilizing the electron as the conductive carriers is referred to a nature where hole injection from the base substance is efficiently blocked and the blocking property is not exhibited for the electrons from the photoconductive layer by containing the N type semiconductive particles in the insulative binder.

A method for discriminating the N type semiconductive particles is illustrated.

An intermediate layer with a film thickness of 5 μm is formed on the conductive support. The intermediate layer is formed using a dispersion liquid in which particles at 50% by mass are dispersed in the binder resin which composes the intermediate layer. The intermediate layer is charged negative, and a photo-induced discharge property is evaluated. Also it is charged positive, and the photo-induced discharge property is similarly evaluated.

N type semiconductive particle is referred to the particle dispersed in the intermediate layer in the case where the photo-induced discharge when charged negative is larger than that when charged positive.

The above N type semiconductive particles specifically include fine particles of titanium oxide ($TiO_2$), zinc oxide (ZnO), tin oxide ($SnO_2$) and the like, and in particular titanium oxide is preferably used.

An average particle diameter of the N type semiconductive particles used for the invention is preferably one in the range of 100 nm or more and 500 nm or less, more preferably from 10 nm to 200 nm, and particularly preferably from 15 nm to 50 nm in a number average primary particle diameter.

The intermediate layer using the N type semiconductive particles where the number average primary particle diameter is in the above range can make the dispersion in the layer dense and has sufficient electric potential stability and anti-small black spot occurrence function.

The number average primary particle diameter of the N type semiconductive particles, for example, in the case of titanium oxide, is measured as the number average diameter of Feret diameter by magnifying at 10000 folds in transmitted electron microscope observation, observing and image-analyzing randomly selected 100 particles as primary particles.

Shapes of the N type semiconductive particles are dendritic, needle, and granular shapes. For the N type semiconductive particles in such shapes, for example, in titanium oxide particles, there are an anatase type, a rutile type and an amorphous type, and the like as crystal types. The crystal of any type may be used, and the crystal types may be used in mixture with two or more. Among them, the rutile type is the best.

One of hydrophobing surface treatments given to the N type semiconductive particles is one where multiple times of surface treatments are performed and a final surface treatment in the multiple times of surface treatments is performed with a reactive organic silicon compound. Also, it is preferable that at least one surface treatment is the surface treatment with one or more types selected from alumina, silica and zirconia in the multiple times of the surface treatments and that the final surface treatment is performed with the reactive organic silicon compound.

An alumina treatment, a silica treatment or a zirconia treatment indicates the treatment where alumina, silica or zirconia is precipitated on the surface of the N type semiconductive particles. These alumina, silica and zirconia precipitated on the surface include hydrates of alumina, silica and zirconia. The surface treatment with the reactive organic silicon compound indicates that the reactive organic silicon compound is used in a treatment solution.

The surface of the N type semiconductive particles is evenly surface-coated (treated) by performing the surface treatment of the N type semiconductive particles such as titanium oxide particles at least twice according to the above-described way. When the surface-treated N type semiconductive particles for the intermediate layer is used, it is possible to obtain the good photoconductor where dispersibility of the N type semiconductive particles such as titanium oxide particles in the intermediate layer is good and image defects such as small black spots do not occur.

For the intermediate layer, it is preferred that the above semiconductive particles are dispersed in the binder resin to form the intermediate layer. As the binder resins in the intermediate layer, polyamide resins, vinyl chloride resins, vinyl acetate resins, and copolymer resins comprising two or more repeat units of these resins are included. In these under coating resins, the polyamide resins are preferable as a resin capable of maximally reducing the residual potential increase involved in the repeat uses. An average particle diameter of the above semiconductive particles is preferably from 0.01 to 1 μm. A film thickness of such an intermediate layer is preferably from 0.5 to 20 μm.

Shapes of the titanium oxide particles are dendritic, needle, and granular shapes. For titanium oxide particles in such shapes, for example, for titanium oxide particles, there are an anatase type, a rutile type and an amorphous type, and the like as crystal types. Any type of the crystal types may be used, and the crystal types may be used in mixture with two or more. In these, the rutile type and the granular shape are the best.

It is preferred that the titanium oxide particles of the invention are surface-treated. One of the surface treatments is one where multiple times of surface treatments are performed and a final surface treatment in the multiple times of surface treatments is performed by the surface treatment with a reactive organic silicon compound. Also, it is preferred that at least one surface treatment is the surface treatment with one or more types selected from alumina, silica and zirconia in the multiple times of the surface treatments and that the surface treatment with the reactive organic silicon compound is finally performed.

The surface of the titanium oxide particles is evenly surface-coated (treated) by performing the surface treatment of the titanium oxide particles such as titanium oxide particles in this way at least twice. When using the surface-treated titanium oxide particles for the intermediate layer, it is possible to obtain the good photoconductor where dispersibility of the titanium oxide particles such as titanium oxide particles in the intermediate layer is good, and image defects such as small black spots do not occur.

An alumina treatment, a silica treatment or a zirconia treatment is referred to the treatment where alumina, silica or zirconia is precipitated on the surface of the titanium oxide particles. These alumina, silica and zirconia precipitated on the surface include hydrates of alumina, silica and zirconia. The surface treatment with the reactive organic silicon compound means that the reactive organic silicon compound is used in a treatment solution.

The above reactive organic silicon compounds include the compounds represented by the following general formula (1), but are not limited to the following compounds so long as the compounds perform a condensation reaction with reactive groups such as hydroxyl groups on the surface of titanium oxide.

$$(R)_n—Si—(X)_{4-n} \qquad \text{General formula (1)}$$

Wherein Si represents a silicon atom, R represents an organic group in a form where carbon is directly bound to the silicon atom, X represents a hydrolytic group, and n represents an integer of 0 to 3.

In the organic silicon compound represented by the general formula (1), the organic groups in the form where carbon is directly bound to the silicon atom include alkyl groups such as methyl, ethyl, propyl, butyl, pentyl, hexyl, octyl and dodecyl, aryl groups such as phenyl, tolyl, naphthyl and biphenyl, epoxy-containing groups such as γ-glycidoxypropyl and β-(3,4-epoxycyclohexyl)ethyl, (meth) acryloyl-containing groups such as γ-acryloxypropyl and γ-methacryloxypropyl, hydroxyl-containing groups such as γ-hydroxypropyl and 2,3-dihydroxypropyloxypropyl, vinyl-containing groups such as vinyl and propenyl, mercaptocontaining groups such as γ-mercaptopropyl, amino-containing groups such as γ-aminopropyl and N-â(aminoethyl)-γ-aminopropyl, halogen-containing groups such as γ-chloropropyl, 1,1,1-trifluoropropyl, nonafluorohexyl and perfluorooctylethyl, and additionally, nitro-, cyano-substituted alkyl groups. The hydrolytic groups of X include alkoxy groups such as methoxy and ethoxy, halogen groups and acyloxy groups.

The organic silicon compounds represented by the general formula (1) may be used alone or in combination with two or more.

In the specific compound of the organic silicon compounds represented by the general formula (1), when n is 2 or more, the multiple Rs may be the same or different. Likewise, when n is 2 or less, multiple Xs may be the same or different. When two or more of the organic silicon compounds represented by the general formula (1) are used, R and X may be the same or different in the respective compounds.

As the reactive organic silicon compounds preferable for the use in the surface treatment, polysiloxane compounds are included. The polysiloxane compound with a molecular weight of 1000 to 20000 is generally available and anti-small black spot occurrence function thereof is also good.

Particularly, good effects are obtained when methylhydrogen polysiloxane is used for the final surface treatment.

Solvents or dispersion medium used for the formation of layers such as the intermediate layer, the charge generating layer and the charge transport layer include n-butylamine, diethylamine, ethylenediamine, isopropanolamine, triethanolamine, triethylenediamine, N,N-dimethylformamide, acetone, methylethylketone, methylisopropylketone, cyclohexane, benzene, toluene, xylene, chloroform, dichloromethane, 1,2-dichloroethane, 1,2-dichloropropane, 1,1,2-trichloroethane, 1,1,1-trichloroethane, trichloroethylene, tetrachloroethane, tetrahydrofuran, dioxolane, dioxane, methanol, ethanol, butanol, isopropanol, ethyl acetate, butyl acetate, dimethylsulfoxide, methyl Cellosolve, and the like. The solvent or dispersion medium are not limited thereto, but dichloromethane, 1,2-dichloroethane, methylethylketone and the like are preferably used. These solvents can be used alone or as mixed solvents of two or more.

Next, as a coating method for manufacturing the organic photoconductor, the coating methods such as dip coating, spray coating and circular coating of an amount regulating type are used, but it is preferable to use the coating methods such as spray coating and circular coating of an amount regulating type of which a circle slide hopper type is a representative in coating at upper side of the photoconductive layer, in order to prevent dissolving the film at a lower side as possible and in order to accomplish the uniform coating. In coating a protection layer, it is the most preferable to use the circular coating of an amount regulating type method. The circular coating of an amount regulating type method is described in detail, for example in JP Tokukaisho-58-189061A.

The layer structure of the photoconductor can be conductive support-CGL-GTL. In this structure, the intermediate layer can be disposed either of between the support and the CTL, or between the support and the CGL.

Next, an image forming apparatus using the organic photoconductor is illustrated.

Figure 3:
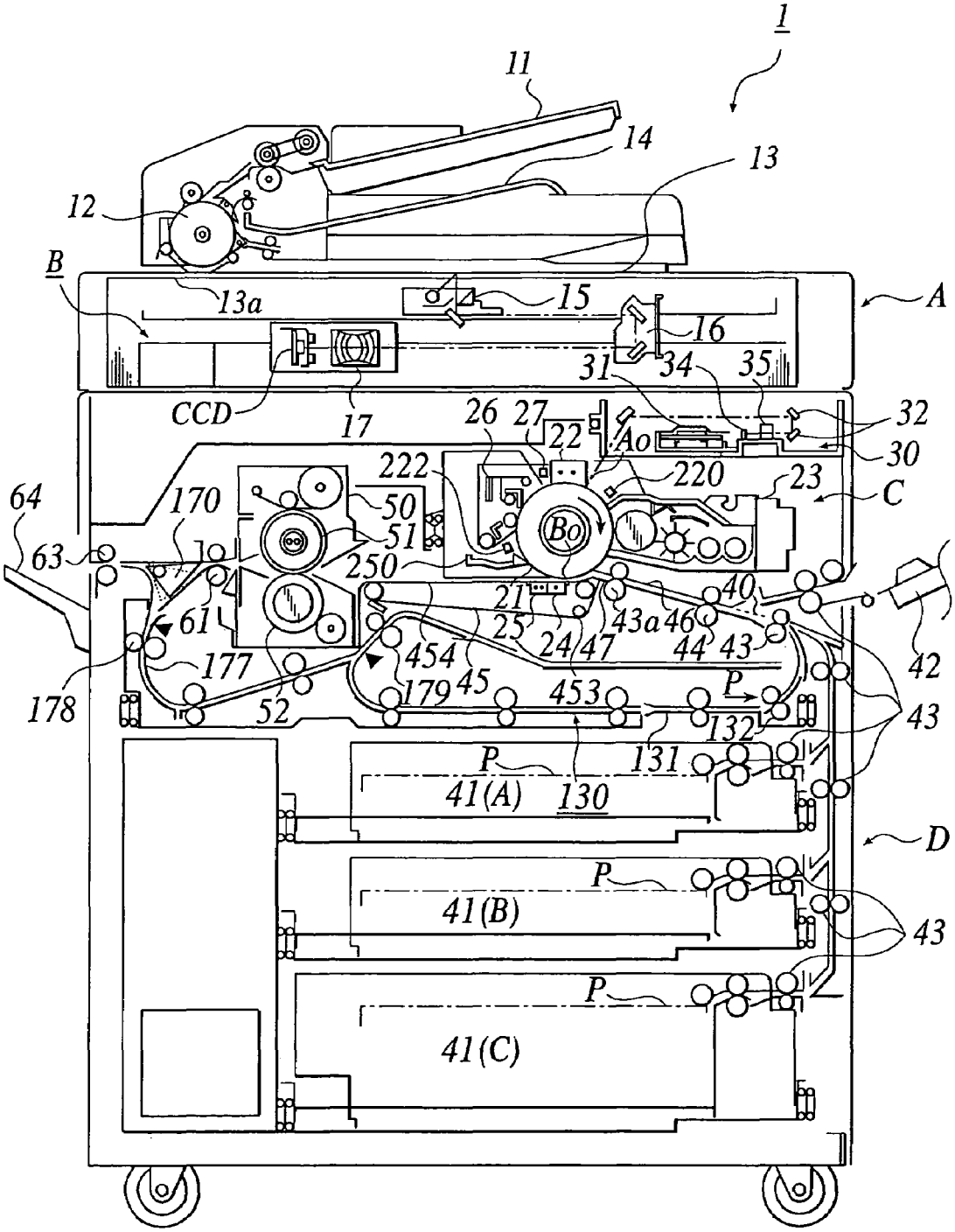
FIG. 3 is a sectional schematic view of one example of an image forming apparatus using the organic photoconductor.

FIG. 3 is a sectional schematic view of the image forming apparatus using the organic photoconductor.

The image forming apparatus 1 shown in FIG. 3 is the image forming apparatus on a digital basis, and is composed of an image reading section A, an image processing section B, an image forming section C and a transfer paper feeding section D as a transfer paper feeding member.

An automatic document feeding member which automatically feeds documents is installed at an upper part of the image reading section A, the documents placed on a document placing table 11 are separately fed one by one by a document feeding roller 12, and reading of an image is performed at a reading position 13*a*. The documents which has been completed document reading are discharged onto a document discharge plate 14 by the document feeding roller 12.

Meanwhile, the image of the document in the case of being placed on a platen glass 13 is read by a reading motion with speed v of a first mirror unit 15 made up of a lighting lamp and the first mirror, which compose a scanning optical system, and a moving with speed v/2 in the same direction of a second mirror unit 16 made up of the second and third mirrors placed in a wedge shape.

The read image is imaged through a projection lens 17 on a photo accepting face of an imaging device CCD which is a line sensor. A line shaped optical image imaged on the imaging device CCD is sequentially photoelectrically converted to electric signals (luminance signals), then A/D conversion is given, and at the image processing section B, processing such as density conversion and filter processing are given. Subsequently, the image data are once stored in memory.

In the image forming section C, a drum-shaped photoconductor 21 which is an photoreceptor, a charging member (charging step) 22 outside thereof which electrifies the photoconductor 21, a potential detection member 220 which detects surface potential of the electrified photoconductor, a development member (development step) 23, a transfer feeding belt unit 45 which is a transfer member (transfer step), a cleaning unit (cleaning member, cleaning step) 26 of the photoconductor 21 and PCL (precharge lamp) 27 as a photo charge neutralization member (photo neutralization charge generating step) are disposed in sequence of the operation, respectively. A reflection density detection member 222 which measures the reflection density of a patch image developed on the photoconductor 21 is installed at a downstream side of the development member 23. The organic photoconductor is used for the photoconductor 21, and driven and rotated clockwise as shown in the figure.

Uniform charging is given to the rotating photoconductor 21 by the charging member 22. Subsequently, image exposure based on image signals called up from the memory at the image processing section B is performed by an exposure optical system 30 as an image exposure member (image exposure step). In the exposure optical system 30 as the image exposure member which is a writing member, laser diode which is not shown in the figure is a luminescence light source, and main scanning is performed by turning a light path by reflection mirrors 32 via a rotating polygon mirror, fθ lens 34 and a cylindrical lens 35. The image exposure is performed at a location of $A_0$ on the photoconductor 21, and an electrostatic latent image is formed by the rotation of the photoconductor (subscanning). In one of the embodiments, the electrostatic latent image is formed by performing the exposure for an image section.

It is assumed for the organic photoconductor that a digital image with resolution of 1200 dpi or more is recorded and an electrostatic latent image is formed. In order to form the electrostatic latent image of such a dot image with high resolution on the photoconductor, it is preferable to perform the image exposure using an exposure beam where a spot area is $5.00\times10^{-10}$ $m^2$ (500 $\mu m^2$) or less.

Even when such a beam exposure with small diameter is performed, the organic photoconductor can faithfully form the electrostatic image corresponding to the spot area, and accomplish an electrophotographic image having a dot image with 1200 dpi (dpi refers to a dot number per 2.54 cm) or more, which is good in sharpness and rich in gradation property. A dot image resolution formed on the organic photoconductor is 1200 dpi or more, preferably from 1200 to 3000 dpi, and more preferably from 1200 to 2500 dpi. In order to increase the dot image resolution, it is necessary to further reduce the spot area of above exposure beam when the photoconductor is exposed.

The spot area of the above exposure beam is represented by an area where the light intensity of the beam is not less than $1/e^2$ of peak intensity.

As the exposure beam used, there are a scanning optical system using semiconductor laser, a solid scanner such as LED and liquid crystal shutter, and the like. For a light intensity distribution, there are Gauss distribution, Lorentz distribution and the like, and a part up to $1/e^2$ of the peak intensity is rendered the spot area.

It is preferable to add the charging potential of −200 to −400 V to the photoconductor 21. When the image exposure is performed under the condition in which the charging potential of such low voltage is added, a dot latent image is formed without the diffusion of carriers and the dot image corresponding to the spot area of the above image exposure is formed. When the charging potential is less than −200 V, the development property may be easily reduced and it may be difficult to obtain sufficient image density. On the other hand, when the charging potential is more than −400 V, carrier diffusion at the formation of latent image may easily become large and the sharpness may be easily deteriorated.

The electrostatic latent image on the photoconductor 21 is reversely developed by the development member 23, and a toner image of a visible image is formed on the surface of the photoconductor 21. In the electrophotographic photoconductor, a process speed of the image formation is fast, and the effect is remarkably manifested particularly when the electrophotographic image is formed at a high line speed of the photoconductor of 300 mm/sec or more, preferably 350 mm/sec or more and 600 mm/sec or less. The photoconductor can be driven by a driving member (a photoconductor actuating member).

At such a high line speed, a moving time (Td) of the photoconductor from the image exposure step to the development step is shorten at a high process speed, and in the electrophotographic photoconductor which is insufficient in high speed compatibility, when the step reaches the development step, potential reduction by the image exposure may not be completed. Even when the electrophotographic photoconductor is applied to the high speed process where the moving time (Td) from the image exposure step to the development step is 130 msec or less, the potential reduction is sufficiently completed at the development step. The photoconductor of the invention, in which deterioration of high speed property due to the repeat uses is also small, further has sufficient compatibility to high speed even under low temperature and low humidity environments.

The moving time (Td) from the image exposure step to the development step of the invention can be calculated by dividing a distance (A to B) on the photoconductor between a location where the image exposure irradiated on the photoconductor is completed (location A on the photoconductor) and a location where the toner initiates to adhere by the development (location B on the photoconductor) by the line speed of the photoconductor at the operation of image formation (surface line speed of the photoconductor).

In the image forming method, it is preferable to use polymerized toner for a developer used at the development member. By combining the polymerized toner having uniform distribution of shapes and particle size with the organic photoconductor, it is possible to obtain the electrophotographic image with better sharpness.

Here, the polymerized toner indicates a toner in which the binder resin for toner and the toner shape are formed by polymerization of monomer material of the binder resin and following chemical treatments. More specifically, it indicates the toner is obtained via a polymerization reaction such as suspension polymerization and emulsification polymerization and a fusion step of particles one another which is subsequently performed if necessary.

The polymerized toner is manufactured by dispersing the basic material monomer evenly in an aqueous system followed by polymerization, and thus the toner where particle size distribution and shapes are uniform is obtained.

The polymerized toner can be manufactured by the suspension polymerization method or by the method where polymerized particles of fine particles are manufactured by emulsifying/polymerizing monomer in a solution to which an emulsified solution of necessary additives is added followed by adding an organic solvent, coagulant and the like to associate. The method for preparation by mixing a dispersion solution of a releasing agent and a coloring agent required for the configuration of toner at the association to associate, and the method where constituents of the toner such as the releasing agent and the coloring agent are dispersed in the monomer and subsequently the emulsification polymerization is performed are included. Here, the association indicates that multiple resin particles and multiple coloring agent particles are fused.

That is, various configuration materials such as a coloring agent, if necessary a releasing agent, charge controlling agent and further a polymerization initiator are added into polymerizable monomer, and the various configuration materials are dissolved or dispersed in the polymerizable monomer by a homogenizer, sand mill, sand grinder, ultrasonic dispersing machine, and the like. This polymerizable monomer where the various configuration materials are dissolved or dispersed is dispersed in an aqueous solvent containing a dispersion stabilizer as oil droplets with the desired size as the toner using a homomixer, homogenizer and the like. Subsequently, the content is transferred into a reaction apparatus where a agitation mechanism is a mixing impeller mentioned below, and the polymerization reaction is carried forward by heating. After the termination of the reaction, the toner is prepared by eliminating the dispersion stabilizer, filtrating, washing and further drying.

Also, as the method for manufacturing the toner, it is possible to include the method for preparing by associating or fusing resin particles in an aqueous solvent. This method is not particularly limited, but can include, for example, the methods shown in JP Tokukaihei-5-265252A, JP Tokukaihei-6-329947A and JP Tokukaihei-9-15904A. That is, the toner can be formed by the method of associating multiple dispersion particles of configuration materials such as resin particles and a coloring agent, or multiple fine particles composed of the resin and the coloring agent, in particular, by dispersing these in water using an emulsifier, subsequently salting out by adding a coagulant at a critical coagulation concentration or more and simultaneously making particle diameters gradually grow as forming fused particles by heating/fusing at a temperature equal to or more than a glass transition temperature of the formed polymer itself, then stopping the growth of particle diameters by adding a large amount of water when the aimed particle diameters are obtained, further controlling the shape by smoothing the particle surface with heating and stirring, and heating/drying those particles containing water in a fluid state. Here, an organic solvent which unlimitedly dissolves in water may be added in parallel with the coagulant.

The materials, the methods and the reaction apparatus of polymerized toner for manufacturing the toner with uniform shape used in the invention are described in detail in JP Tokukai-2000-214629A.

At the transfer paper feeding section D, paper supply units 41(A), 41(B) and 41(C) as the transfer paper housing members where the transfer paper P with different size are housed are installed underneath the image formation unit. Also, a manual paper feeding unit 42 which performs the manual paper feeding is installed at the side. A transfer paper P selected from any of them is supplied along a feeding path 40 by a guiding roller 43. The transfer paper P is once stopped by a resist roller pair 44 which fixes a slop and deflection of the supplied transfer paper P, subsequently fed again, and guided to a feeding path 40, a pretransfer roller 43*a*, a paper supply path 46 and an entering guide plate 47. A toner image on the photoconductor 21 is transferred onto the transfer paper P at a transfer location $B_0$ with being placed and fed on a transfer feeding belt 454 of a transfer feeding belt unit 45 by a transfer pole 24 and a separation pole 25. The transfer paper P is separated from the photoconductor 21 face, and fed to a fixing member 50 by the transfer feeding unit 45.

The fixing member 50 has a fixing roller 51 and a pressing roller 52, and fixes the toner by heating and pressing by passing the transfer paper P between the fixing roller 51 and the pressing roller 52. The transfer paper P which finishes the fixing of the toner image is discharged onto a paper catch tray 64.

The above illustrates a state where the image formation is performed on one side of the transfer paper. In the case of a double sided copy, a paper discharge switching component 170 is switched, a transfer paper guiding section 177 is opened, and the transfer paper is fed toward a dot-line direction.

Further, the transfer paper P is fed downward by a feeding mechanism 178, switched back by a transfer paper reverse section 179, and fed into a paper supply unit for the double sided copy 130 by making a back end part a front end part of the transfer paper P.

The transfer paper P moves on a feeding guide 131 installed in the paper supply unit 130 for the double sided copy toward a direction of paper supply, supplied again by a paper supply roller and guided to the feeding path 40.

Again, as mentioned above, the transfer paper P is fed toward a direction of the photoconductor 21, the toner image is transferred on a back side of the transfer paper P, which is fixed at the fixing member 50 followed by being discharged on the paper catch tray 64.

As the image forming apparatus of the invention, constituents such as the above photoconductor, development means and cleaning means may be integrated and configured as a process cartridge, and this unit may be configured removably for the system main body. Also, at least one of an charging member, image exposure member, development member, transfer member or separation member and cleaning member may be integrated along with the photoconductor and form a process cartridge to make a single unit removable for the system main body, and make a removable configuration using a guiding member such as rail in the system main body.

EXAMPLES

The invention is illustrated in detail below by referring to examples, but the aspects of the invention are not limited thereto. "Part" in the text represents "part by mass".

Example 1

<<Manufacture of Photoconductor 1 Group>>

<Intermediate Layer (UCL)>

The following intermediate layer application composition was prepared and coated on a cylindrical aluminum base substance with a diameter of 80 mm after washing in a dip coating method to form an intermediate layer.

(Manufacture of Intermediate Layer Dispersion Solution)

| | |
|---|---|
| Binder resin (polyamide resin) | 1 part |
| Anatase type titanium oxide (primary particle diameter: 35 nm; the surface is treated with ethyl fluoride trimethoxysilane) | 3.0 part |
| Isopropyl alcohol | 10 part |

The above ingredients were mixed and dispersed for 10 hours by a batch mode using a sand mill dispersing machine to make an intermediate layer dispersion solution.

The intermediate layer dispersion solution was diluted twice with the same mixing solvent, settled overnight, and subsequently filtrated (filter: Rigimesh filter supplied from Nippon Pall Ltd., nominal filtration accuracy: 5 μm; pressure: 50 kPa) to make an intermediate layer application composition. The application composition was coated on the cylindrical aluminum base substance by a dip coating method and heating at 120° C. for one hour to form an intermediate layer with a dried film thickness of 4.0 μm. The volume resistance of the intermediate layer after drying was $3\times10^{13}$ Ω·cm under the above measurement condition.

<Charge Generating Layer (CGL)>

| | |
|---|---|
| CGM: Y type oxytitanyl phthalocyanine (titanyl phthalocyanine pigments where a maximum peak angle is at 27.3 in Bragg 2θ in X-ray diffraction spectrum of Cu-Kα character X-ray) | 20 parts |
| Polyvinyl butyral (#6000-C, Denki Kagaku Kogyo KK) | 10 parts |
| t-Butyl acetate | 700 parts |
| 4-Methoxy-4-methyl-2-pentanone | 300 parts |

The above composition was mixed and dispersed using a sand mill to prepare a charge generating layer application composition. This application composition was coated in a dip coating method to form a charge generating layer with a dry film thickness of 0.3 μm on the intermediate layer.

<Charge Transport Layer (CTL)>

| | |
|---|---|
| Charge transport material (T-1) | 151 parts, |
| polycarbonate (molecular weight: 30,000) | 300 parts, |
| anti-oxidant Z(Irganox 1010, Ciba-Gaigy Japan Ltd.) | 6 parts, |

-continued

| | |
|---|---|
| dichloromethane (solvent) | 2000 parts, |
| silicon oil (KF-54, supplied from Shin-Etsu Chemical Co., Ltd.) | 1 part |

The above composition was mixed and dissolved to prepare a charge transport layer application composition. This application composition was coated on the above charge generating layer by a circle amount regulation type coating method, dried at 125° C. for 70 min to make a residual solvent of 100 ppm or less. The charge transport layers having film thickness of 17 μm, 15 μm, 14 μm, 9 μm, 8 μm, and 6 μm were formed respectively to make the photoconductor 1*a* (film thickness of the charge transport layer is 17 μm), the photoconductor 1*b* (film thickness of the charge transport layer is 15 μm), the photoconductor 1*c* (film thickness of the charge transport layer is 14 μm), the photoconductor 1*d* (film thickness of the charge transport layer is 9 μm), the photoconductor 1*e* (film thickness of the charge transport layer is 8 μm) and the photoconductor 1*f* (film thickness of the charge transport layer is 6 μm). A percentage of the charge transport material (CTM) in the charge transport layer of these photoconductors 1*a* to 1*f* is 33% by mass.

<<Manufacture of Photoconductors 2 Group to 7 Group>>

The photoconductors 2*a* to 7*a* (film thickness of the charge transport layer is 15 μm), the photoconductors 2*b* to 7*b* (film thickness of the charge transport layer is 10 μm), and the photoconductors 2*c* to 7*c* (film thickness of the charge transport layer is 8 μm) were made as is the case with the manufacture of the photoconductor 1 group, except that the charge generation materials in the charge generating layer, the charge transport materials in the charge transport layer, contents and film thickness thereof were changed as shown in Table 1A and Table 1B.

<<Manufacture of Photoconductor 8 Group>>

The photoconductors 8*a*, 8*b* and 8*c* where the following protection layer was further laminated on the charge transport layer in the manufacture of the photoconductor 1 group were made.

<Protection Layer>

| | |
|---|---|
| Organic segment component A solution (vinyl type polymer A solution having hindered amine group obtained from the following synthetic example and silyl-modified) | 100 parts, |
| methyltrimethoxysilane | 70 parts, |
| dimethyldimethoxysilane | 30 parts, |
| i-butyl alcohol | 100 parts, |
| butyl Cellosolve | 75 parts, |
| di-i-propoxyethylacetoacetate aluminium | 10 parts |

The above composition was mixed, thoroughly stirred, subsequently 30 parts of pure water was dripped under stirring, and a mixture was reacted at 60° C. for 4 hours. Then, the reaction was cooled to room temperature, 50 parts of dihydroxymethyl triphenylamine and 5 parts of aluminium tris(acetylacetonate) were added and stirred to prepare an application composition. This application composition was coated on the above charge transport layer by a circle amount regulation type coating apparatus to form a protection layer with a film thickness of 2 μm. Heating cure at 120° C. for one hour was performed to make the photoconductor 8*a* (film thickness of the charge transport layer is 15 μm), the photoconductor 8*b* (film thickness of the charge transport layer is 10 μm), and the photoconductor 8*c* (film thickness of the charge transport layer is 8 μm). The volume resistance of the protection layer after drying was $4\times10^{14}$ Ω·cm under the above measurement condition.

(Synthetic Example of Organic Segment Component A)

The organic segment component A solution is a vinyl type polymer A solution with solid content of 40% having hindered amine group at a side chain and having silyl group To a reaction container comprising a reflux condenser and a stirrer, 25 parts of ã-methacryloyloxypropyl trimethoxysilane as a monomer, 1 part of 4-methacryloyloxy-1,2,2,6,6-pentamethylpiperidine, 80 parts of methyl methacrylate, 15 parts of methacrylate 2-ethylhexyl, 29 parts of n-butyl acrylate, 150 parts of 2-propanol, 50 parts of 2-butanone and 25 parts of methanol were added and mixed, then, heated to 80° C. with stirring, a solution of 4 parts of azobisisovaleronitrile dissolved in 10 parts of xylene was dripped into this mixture over 30 min, and subsequently reacted at 80° C. for 5 hours to yield a vinyl type polymer A solution with solid content of 40% having hindered amine group at a side chain and having silyl group.

<<Manufacture of Respective Photoconductors for TOF Measurement>>

The respective photoconductors for TOF measurement were made where the respective intermediate layers, charge generating layers, charge transport layers and protection layers (only for the photoconductor 8 group) are formed as is the case with the manufacture of the above photoconductor 1 group to 8 group, except that the cylindrical aluminum base substance with a diameter of 80 mm was replaced with a support where aluminum was deposited on PET base.

<Evaluation 1: Evaluation of TOF>

Transient photocurrent (TOF) of each photoconductor was measured using each photoconductor for TOF measurement under the above TOF measurement condition, subsequently a curve as shown in FIG. 2 was made by plotting integrated values of detected current versus time from the data of transient photocurrent (TOF) measurement, and a crossing angle α of a tangent line A beginning at a coordinate origin and a tangent line B beginning at 3000 μsec of each photoconductor was obtained from the curve. The charging potential was set such that V/d was 10 V/μm where a sum of film thickness in the intermediate layer, the charge generating layer, the charge transport layer and the protection layer is d. These results are shown in Table 1A and Table 1B.

<Evaluation 2>

Printing evaluation was carried out by continuously printing an image where characters with a pixel rate of 8% and half torn parts were mixed on 50,000 pieces of A4 size paper under ambient temperature and humidity (20° C. and 50% RH) using a digital copier (a modified Konica 7165 machine (modified to be capable of printing with 1200 dpi): line speed of the photoconductor 370 mm/sec) in which each photoconductor is installed.

<Evaluation Items and Standards>

(Reproducibility of DOT Image)

Reproducibility of dots which compose the image was observed to evaluate using a magnifying lens at 100 folds. Monochrome images at the start of printing (S), after printing 10,000 pieces (10,000) and after printing 50,000 pieces (50,000) were evaluated.

A: The dot images are each independently reproduced with an increase and decrease of less than 30% compared to the exposure spot area (good);

B: The dot images are each independently reproduced with an increase and decrease of 30% to 60% compared to the exposure spot area (practical level); and D: The dot images are reproduced with an increase and decrease of more than 60% compared to the exposure spot area, and the dot images partially disappear or link (practically problematic level)

(Periodic Image Defects)

Occurrence of image defects corresponding to cycles of the photoconductor was evaluated (occur as small black spots (including colored spots) and dropout parts or linear image defects). Monochrome images after printing 50,000 sheets were evaluated.

A: Almost no occurrence of clear periodic image defect is observed (the number of small black spots are 3 per A4 size paper and a density of lines is 0.02 or less; good);

B: Occurrence of clear periodic image defects is within practical use (the number of small black spots are from 4 to 10 or less per A4 size paper, and a density of lines is from 0.03 to 0.04; practical level);

C: The clear periodic image defects occur and they are in the range where review about practicality is required (the number of small black spots are from 11 to 20 or less per A4 size paper and a density of lines is from 0.05 to 0.06; level required the review about practicality); and D: The clear periodic image defects frequently occur (the number of small black spots are 21 or more per A4 size paper and a density of lines is 0.07 or more; practically problematic level).

(Sharpness)

Sharpness of the image was evaluated by resolution of a line image. The evaluation was performed by the following judgment standards. Monochrome images after printing 50,000 pieces were evaluated.

A: The resolution of line image accomplishes 16 lines/mm or more (good);

B: The resolution of line image accomplishes from 10 to 15 lines/mm (no practical problem); and D: The resolution of line image is 9 lines/mm or less (inadequate as the image of high resolution).

(Gradation Property)

An original image possessing 60 gradation steps from a white image to an all black image was copied and gradation property was evaluated. The image was visually observed to evaluate the image with gradation differences under a sufficient daylight condition, and by a total number of significant gradation steps.

A: The gradation steps are 41 or more (good);

B: The gradation steps are from 21 to 40 (no practical problem);

C: The gradation steps are from 11 to 20 (review of practicality is required: practical in image quality where the gradation property is not stressed); and D: The gradation differences are 10 or less (practically problematic).

(Photographic FOG)

With respect to levels of photographic fog and small black spots on the image, the evaluation was performed by photographic fog density (relative density to that of a transfer body) and the number of visually distinctive black spots on an all white image according to the following judgment standards. Monochrome images after printing 50,000 pieces were measured for the evaluation.

A: The photographic fog density is less than 0.01 (good);

B: The photographic fog density is 0.01 or more and less than 0.02 (no practical problem); and D: The photographic fog density is 0.02 or more (practically problematic).

(Increase Amount of Residual Potential (ÄVr))

For residual potential, a variation amount of the residual potential was calculated before and after printing 50,000 pieces.

(Wear and Tear Amount of Film Thickness in Photoconductor)

(A wear and tear amount of film thickness in photoconductor) (μm)=(Photoconductor film thickness at the start of image evaluation)−(Photoconductor film thickness after printing 50,000 pieces)

Method for measuring photoconductor film thickness is described below. For the film thickness of photoconductive layer, randomly selected 10 sites of uniform film thickness portions are measured, and an average value thereof is rendered the film thickness. Measurement of the film thickness was performed using an eddy-current film thickness tester, EDDY 560C (Helmut Fischer GMBTE Co.).

(Other Evaluation Conditions)

Charging condition of photoconductor: An aimed electric potential was −800 V such that the electric potential at non-image portions can be detected by an electric potential sensor and feedback-controlled.

Image exposure: Semiconductor laser (wavelength: 650 nm)

Image exposure condition: Semiconductor laser, an exposure spot area: $3.54\times10^{-10}$ $m^2$, 1200 dpi.

Charge Neutralization Condition:

As an charge neutralization condition before charging, LED light with 680 nm (light quantity value three times or more of light quantity required for reaching an electric potential at an exposure site) was irradiated. A value of surface electric potential after the charge neutralization was measured as the residual potential.

Development Condition: The Following Developer was Used.

Developer: Development was performed by reversal development using toner where 0.5 parts by mass of hydrophobic silica (hydrophobic degree=75/number average of primary particle diameter=12 nm) and 0.25 parts by mass of titanium oxide of 0.05 μm were added to 100 parts by mass of colored particles of a volume average of 5.2 μm made by a polymerization method where carbon clack is a colored pigment, and ferrite carrier of 45 μm coated with resin (a mixing ratio of the toner to the carrier is 1/10 in a mass ratio).

The Evaluation Results Are Shown in Table 1A and Table 1B.

TABLE 1A

| PHOTOCONDUCTOR GROUP NO. | | CGL CGM | CTL CTM | CTL CTM CONCENTRATION | CTL FILM THICKNESS (μm) | TOF CROSSING ANGLE α (°) | CHARGED ELECTRIC POTENTIAL |
|---|---|---|---|---|---|---|---|
| PHOTOCONDUCTOR 1 | a | G-1 | T-1 | 33 | 17 | 74 | −800 |
| | b | | | | 15 | 75 | −800 |
| | c | | | | 14 | 76 | −800 |
| | d | | | | 9 | 78 | −800 |
| | e | | | | 8 | 80 | −800 |
| | f | | | | 6 | 82 | −800 |
| PHOTOCONDUCTOR 2 | a | G-1 | T-2 | 27 | 15 | 70 | −800 |
| | b | | | | 10 | 72 | −800 |
| | c | | | | 8 | 73 | −800 |
| PHOTOCONDUCTOR 3 | a | G-1 | T-3 | 33 | 15 | 77 | −800 |
| | b | | | | 10 | 80 | −800 |
| | c | | | | 8 | 82 | −800 |
| PHOTOCONDUCTOR 4 | a | G-1 | T-1 | 20 | 15 | 70 | −800 |
| | b | | | | 10 | 73 | −800 |
| | c | | | | 8 | 74 | −800 |
| PHOTOCONDUCTOR 5 | a | G-1 | T-1 | 40 | 15 | 75 | −800 |
| | b | | | | 10 | 79 | −800 |
| | c | | | | 8 | 80 | −800 |
| PHOTOCONDUCTOR 6 | a | G-1 | T-4 | 33 | 15 | 53 | −800 |
| | b | | | | 10 | 60 | −800 |
| | c | | | | 8 | 62 | −800 |
| PHOTOCONDUCTOR 7 | a | G-2 | T-1 | 33 | 15 | 63 | −800 |
| | b | | | | 10 | 68 | −800 |
| | c | | | | 8 | 69 | −800 |
| PHOTOCONDUCTOR 8 | a | G-1 | T-1 | 33 | 15 | 71 | −800 |
| | b | | | | 10 | 73 | −800 |
| | c | | | | 8 | 74 | −800 |

TABLE 1B

| PHOTOCONDUCTOR GROUP NO. | | EVALUATED ITEMS: REPRO-DUCIBILITY OF DOT IMAGE | IMAGE DEFECT | SHARPNESS | GRADATION PROPERTY | FOG | Δ Vr | WEAR AND TEAR OF FILM THICKNESS | REMARK |
|---|---|---|---|---|---|---|---|---|---|
| PHOTOCONDUCTOR 1 | a | D | A | D | C | A | 42 | 2.3 | OUT OF INVENTION |
| | b | B | A | B | B | A | 43 | 2.1 | INVENTION |
| | c | A | A | A | A | A | 44 | 2.2 | INVENTION |
| | d | A | A | A | A | A | 45 | 2.2 | INVENTION |
| | e | A | B | A | A | B | 47 | 2.1 | INVENTION |
| | f | B | B | B | C | D | 48 | 2.2 | OUT OF INVENTION |
| PHOTOCONDUCTOR 2 | a | B | A | A | B | A | 40 | 2.4 | INVENTION |
| | b | A | A | A | A | B | 48 | 2.4 | INVENTION |
| | c | A | B | A | A | B | 54 | 2.3 | INVENTION |
| PHOTOCONDUCTOR 3 | a | B | A | B | B | A | 20 | 3.2 | INVENTION |
| | b | A | A | A | A | B | 27 | 3.3 | INVENTION |
| | c | A | B | A | A | B | 33 | 3.1 | INVENTION |
| PHOTOCONDUCTOR 4 | a | B | A | B | B | A | 20 | 3.2 | INVENTION |
| | b | A | A | A | A | B | 27 | 3.3 | INVENTION |
| | c | A | B | A | A | B | 33 | 3.1 | INVENTION |
| PHOTOCONDUCTOR 5 | a | B | B | B | B | A | 30 | 3.5 | INVENTION |
| | b | B | A | A | A | A | 36 | 3.2 | INVENTION |
| | c | A | B | A | A | B | 39 | 3.1 | INVENTION |
| PHOTOCONDUCTOR 6 | a | D | B | D | D | B | 82 | 2.5 | OUT OF INVENTION |
| | b | B | B | B | B | D | 103 | 2.6 | OUT OF INVENTION |
| | c | B | D | B | C | D | 136 | 2.5 | OUT OF INVENTION |
| PHOTOCONDUCTOR 7 | a | B | B | D | C | B | 67 | 2.4 | OUT OF INVENTION |
| | b | B | B | B | B | D | 89 | 2.3 | OUT OF INVENTION |
| | c | B | D | B | C | D | 108 | 2.3 | OUT OF INVENTION |
| PHOTOCONDUCTOR 8 | a | B | A | B | B | A | 28 | 0.4 | INVENTION |
| | b | A | A | A | A | A | 33 | 0.3 | INVENTION |
| | c | A | A | A | A | B | 34 | 0.4 | INVENTION |

In the table, G-1 represents titanyl phthalocyanine pigment having a maximum peak at 27.2° in Bragg angle (2θ±0.2°) of character X-ray diffraction spectrum specific of Cu—Kα, and G-2 represents titanyl phthalocyanine pigment of (2R, 3R)-2,3-butanediol adduct (described in the example of JP Tokukaihei-8-82942A).

T-1 to T-4 represent the following charge transport materials.

T-1

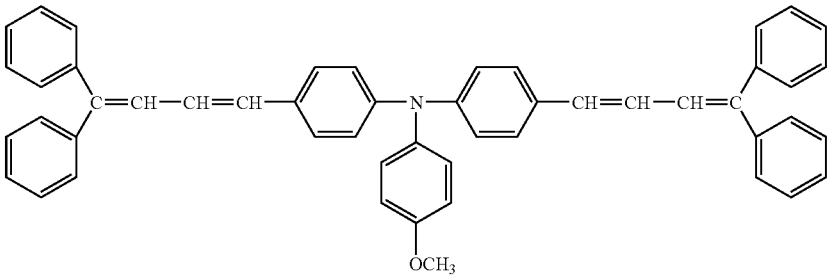

T-2

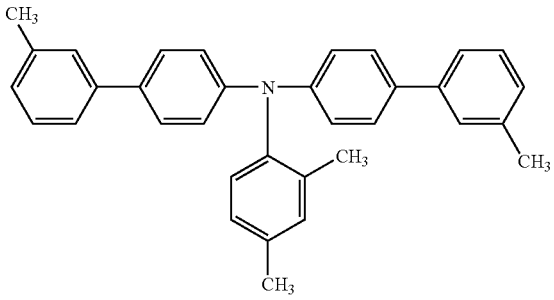

T-3

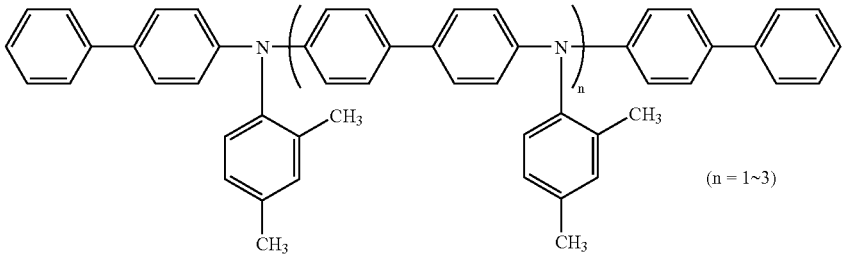

T-4

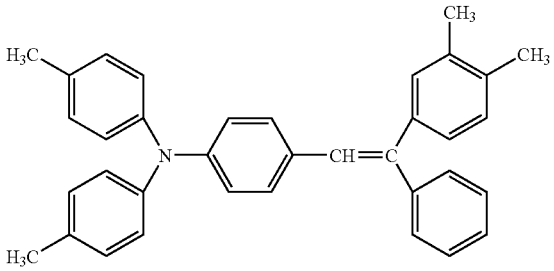

As is obvious from evaluation results shown in Table 1A and Table 1B, the organic photoconductors 1*b* to 1*e*, 2*a* to 2*c*, 3*a* to 3*c*, 4*a* to 4*c*, 5*a* to 5*c* and 8*a* to 8*c* wherein a crossing angle α of two tangent lines is 70° or more which border on a curve obtained when integrated values of detected current are plotted versus time in the (TOF) measurement of transient photocurrent at a field intensity of 10 V/μm and a film thickness of the charge transport layer is 8 to 15 μm are good in dot reproducibility, thus, good in gradation property and sharpness, and occurrence of periodic image defects and increase of residual potential are few. On the other hand, in the photoconductors 6*a* to 6*c* and 7*a* to 7*c* where the above crossing angle α is less than 70°, one or more of the properties in dot reproducibility, gradation property, sharpness, periodic image defect and increase of residual potential are deteriorated. Among these photoconductors, in the organic photoconductors 1*c*, 1*d*, 2*b*, 3*b*, 4*b*, 5*b* and 8*b* where the crossing angle is 70° or more and the film thickness of the charge transport layer is from 9 to 14 μm, improvement effects of respective properties are remarkable.

<Evaluation 3: Image Evaluation>

The photoconductors 1*b* to 1*e* is subject to the evaluation. Image exposure condition in the above evaluation 2 was changed to the followings.

Image exposure condition: Exposure spot area: $9.00\times10^{-11}$ $m^2$, 2400 dpi The Evaluation Results Are Shown in Table 2A and Table 2B.

TABLE 2A

| PHOTOCONDUCTOR GROUP NO. | | CGL CGM | CTL CTM | CTM CONCENTRATION | FILM THICKNESS (μm) | TOF CROSSING ANGLE α (°) | CHARGED ELECTRIC POTENTIAL |
|---|---|---|---|---|---|---|---|
| PHOTOCONDUCTOR 1 | b | G-1 | T-1 | 33 | 15 | 75 | −800 |
| | c | | | | 14 | 76 | −800 |
| | d | | | | 9 | 78 | −800 |
| | e | | | | 8 | 80 | −800 |

TABLE 2B

| PHOTOCONDUCTOR GROUP NO. | | EVALUATED ITEMS REPRODUCIBILITY OF DOT IMAGE | IMAGE DEFECT | SHARPNESS | GRADATION PROPERTY | FOG | Δ Vr | WEAR AND TEAR OF FILM THICKNESS | REMARK |
|---|---|---|---|---|---|---|---|---|---|
| PHOTOCONDUCTOR 1 | b | B | A | A | A | A | 43 | 2.1 | INVENTION |
| | c | A | A | A | A | A | 44 | 2.2 | INVENTION |
| | d | A | A | A | A | A | 45 | 2.2 | INVENTION |
| | e | A | B | A | A | B | 47 | 2.1 | INVENTION |

As the evaluation results, it is shown that the improvement effect of gradation property is enhanced in the exposure condition of 2400 dpi compared to the exposure condition of 1200 dpi in the evaluation 2.

<Evaluation 4: Image Evaluation>

The photoconductor 1 group in the invention is subject to the evaluation. The evaluations were performed as is the case with the evaluation 2 except that the charging condition of the photoconductor in the above evaluation 2 was changed to the followings.

Charging condition of photoconductor: An aimed electric potential was −400 V such that the electric potential at non-image portions can be detected by an electric potential sensor and feedback-controlled.

The evaluation results are shown in Table 3A and Table 3B.

TABLE 3A

| PHOTOCONDUCTOR GROUP NO. | | CGL CGM | CTL CTM | CTM CONCENTRATION | FILM THICKNESS (μm) | TOF CROSSING ANGLE α (°) |
|---|---|---|---|---|---|---|
| PHOTOCONDUCTOR 1 | b | G-1 | T-1 | 33 | 15 | 75 |
| | c | | | | 14 | 76 |
| | d | | | | 9 | 78 |
| | e | | | | 8 | 80 |

TABLE 3B

| PHOTO-CONDUCTOR GROUP NO. | | EVALUATED ITEMS CHARGED ELECTRIC POTENTIAL | REPRODUCI-BILITY OF DOT IMAGE | IMAGE DEFECT | SHARPNESS | GRADATION PROPERTY | FOG | Δ Vr | WEAR AND TEAR OF FILM THICKNESS | REMARK |
|---|---|---|---|---|---|---|---|---|---|---|
| PHOTO-CONDUCTOR 1 | b | −400 | A | A | A | A | A | 43 | 2.1 | INVENTION |
| | c | −400 | A | A | A | A | A | 44 | 2.2 | INVENTION |
| | d | −400 | A | A | A | A | A | 45 | 2.2 | INVENTION |
| | e | −400 | A | A | A | A | B | 47 | 2.1 | INVENTION |

As the evaluation results, it is shown that the improvement effects of sharpness and gradation property are enhanced in the photoconductors 1*b* to 1*e* in the case where the charging condition is the aimed electric potential of −400 V compared to the case where the charging condition is the aimed electric potential of −800 V in the evaluation 2.

<Evaluation 5: Image Evaluation>

The photoconductors 1*b* to 1*e* is subject to the evaluation. The evaluations were performed as is the case with the evaluation 2 except that the charging condition and the image exposure condition of the photoconductor in the above evaluation 4 were changed to the followings.

Charging condition of photoconductor: The evaluations were performed at two levels of −200 and −300 V of the aimed electric potential such that the electric potential at non-image portions was detected by an electric potential sensor and feedback-controlled.

As evaluation results, almost similar effects to those in the case where the aimed electric potential is −400 V in the evaluation 4 were obtained in the photoconductor 1 group of the invention in the case where the charging condition is the aimed electric potential of −200 or −300 V.

<Evaluation 6: Image Evaluation>

The photoconductors 1*b* to 1*e* in the invention is subject to the evaluation. The evaluations were performed as is the case with the above evaluation 4 except that the line speed of the photoconductor was changed from 370 mm/sec to 550 mm/sec.

As evaluation results, even when the line speed 370 mm/sec of the photoconductor was changed to 550 mm/sec, almost similar effects to those in the case of evaluation 4 were obtained.

As obvious from above evaluation results, by the use of the organic photoconductor of the invention, it is possible to form dot images with high image quality of 1200 dpi or more, to provide electrophotographic images which are good in sharpness and gradation property without inferior image, and provide process cartridges, image forming apparatus and methods for image formation using the organic photoconductor.

What is claimed is:

1. An organic photoconductor comprising a composition of a charge generating layer, a charge transport layer and a conductive base, wherein:

crossing angle θ of two tangent lines is 70° or more, two tangent lines which border on a curve drawn by plotting integrated values of detected current versus time in measurement of transient photocurrent (TOF measurement), at a field intensity of 10V/μm; and film thickness of the charge transport layer is 8 to 15 μm.

2. The organic photoconductor of claim 1, wherein a content of a charge transport material in the charge transport layer is about 20 to about 35% by mass.

3. The organic photoconductor of claim 1, wherein the content of charge transport material in the charge transport layer is 20 to 35% by mass.

4. The organic photoconductor of claim 1, further comprising a surface protection layer.

5. The organic photoconductor of claim 1, wherein the film thickness of the charge transport layer is 9 to 14 μm.

6. The organic photoconciuctor of claim 1, comprising an intermediate layer between the charge transport layer and the conductive base.

7. The organic photoconductor of claim 6, wherein volume resistance of the intermediate layer is $1\times10^{8}\Omega\cdot$ or more.

8. The organic photoconductor of claim 6, wherein the intermediate layer comprises N type semiconductor particles.

9. The organic photoconductor of claim 8, wherein the content of a charge transport material in the charge transport layer is 20 to 35% by mass.

10. An image forming apparatus comprising the organic photoconductor of claim 1, a charging member, an exposure member and a developing member.

11. An image forming apparatus of claim 10, wherein the exposure member exposes light on the organic photoconductor to form an image having resolution of 1200 dpi or more.

12. The image forming apparatus of claim 10, wherein the charging member charges the organic photoconductor in charging potential of about −200 to about −400V.

13. The image forming apparatus of claim 10, comprising a photoconductor actuating member capable to drive the organic photoconductor in line speed of 300 mm/sec or more.

14. The image forming apparatus of claim 13, wherein the charging member charges the organic photoconductor in charging potential of −200 to −400V.

15. The image forming apparatus of claim 14, wherein the exposure member records a digital image onto the organic photoconductor in resolution of 1200 to 3000 dpi.

16. A process cartridge removable to an image forming apparatus comprising the organic photoconductor of claim 1 and at least one of a charging member, an exposure member, a developing member, a transferring member and a cleaning member.

17. An image forming method comprising:

charging the organic photoconductor of claim 1, exposing of the charged organic photoconductor in resolution of 1200 dpi or more, and developing an electrostatic latent image formed by the exposure.

18. The image forming method of claim 17, wherein the organic photoconductor is charged in charging potential of −200 to −400V.

19. The image forming method of claim 18, comprising rotating the organic photoconductor in line speed of 300 mm/sec or more.

20. The image forming apparatus of claim 10, wherein the exposure member exposes the organic photoconductor from outside of the organic photoconductor.

* * * * *